United States Patent [19]

Silva

[11] Patent Number: 4,523,895

[45] Date of Patent: Jun. 18, 1985

[54] FLUID INTENSIFIER

[76] Inventors: Ethan A. Silva, 410 McAuley, Oakland, Calif. 94609

[21] Appl. No.: 454,062

[22] Filed: Dec. 28, 1982

[51] Int. Cl.[3] ..... F04B 17/00

[52] U.S. Cl. ..... 417/225; 417/400

[58] Field of Search ..... 417/225, 400, 403, 404

[56] References Cited

U.S. PATENT DOCUMENTS

| | | | |
|---|---|---|---|
| 1,377,585 | 5/1921 | Johanson | 417/225 |
| 2,818,022 | 12/1957 | Kangas | 417/400 X |
| 2,826,149 | 3/1958 | Wrigley | 417/225 |
| 2,970,546 | 2/1961 | White | 417/225 |
| 2,977,040 | 3/1961 | Dulebohn et al. | 417/225 |
| 3,349,995 | 10/1967 | Sheesley | 417/225 |

FOREIGN PATENT DOCUMENTS

| | | | |
|---|---|---|---|
| 809885 | 8/1951 | Fed. Rep. of Germany | 417/400 |

*Primary Examiner*—Leonard E. Smith

*Attorney, Agent, or Firm*—Paul L. Hickman

[57] ABSTRACT

A fluid intensifier characterized by a bistable control mechanism which "remembers" the point in the operating cycle it is in. The bistable control mechanism controls the movement of a reciprocating assembly located within a main cylinder assembly. The reciprocating assembly co-acts with a stationary assembly to pump high pressure fluid from the main cylinder assembly. The fluid intensifier can be powered by an interruptable fluid source since the fluid intensifier will resume operation from its stopping point when fluid pressure is reapplied.

13 Claims, 1 Drawing Figure

FLUID INTENSIFIER

BACKGROUND OF THE INVENTION

1. Field of the Invention

This invention relates generally to pumps and more particularly to piston type fluid intensifiers.

2. Description of the Prior Art

Fluid intensifiers utilize the energy of a low pressure fluid to pump out a portion of the fluid at a higher pressure. Fluid intensifiers are sometimes used as water pumps in remote areas where conventional power sources are not available.

There are two common types of fluid intensifiers, namely "ram" type intensifiers and piston type intensifiers. U.S. Pat. No. 4,212,597 of Mallofre describes a piston type intensifier including a main cylinder provided with a high pressure outlet, a control cylinder provided with a low pressure inlet, a spool disposed within the control cylinder, and a multi-head piston disposed within the main cylinder. When a pressurized fluid source is applied to the low pressure inlet, the multi-head piston is caused (under the control of the spool) to reciprocate within the main cylinder assembly to develop a high fluid pressure at the high pressure outlet.

A problem with prior art piston type fluid intensifiers is that they require a very stable, continuous fluid source in order to operate. Piston type fluid intensifiers tend to become stuck in mid-cycle if the fluid source is interrupted because they depend upon the momentum of continuous operation to control the stroke direction of the pump pistons. If the pump pistons are stopped in mid-cycle by a loss of fluid source pressure, they could equally well move in either direction when fluid source pressure is reapplied. Rather than move in one direction or the other, the pump pistons often jam.

Some prior art piston type fluid intensifiers address this problem by providing biasing mechanisms to prevent the intensifier mechanism from becoming stuck in mid-cycle. For example, Wrigley in U.S. Pat. No. 2,826,149 provides a spring-loaded over-center mechanism for just such a purpose. Problems with biasing mechanisms is that they too can become stuck, and that they add to the cost an intensifier.

Another drawback of prior art piston type intensifiers is that they are often difficult to disassemble for repair or inspection. Due to this limitation, it is difficult to vary the pumping ratio for most prior art piston type intensifiers.

A problem with ram type fluid intensifiers is that they often require priming. For example, most ram type water pumps require manual priming at the start of operation and repriming when they run dry.

Because of these problems, fluid intensifiers have not been utilized extensively. What the prior art fails to disclose, then, is a fluid intensifier which does not require priming, which can operate from an erratic fluid source, and which can be easily disassembled for repair and modification.

SUMMARY OF THE INVENTION

A major objective of this invention is to provide a fluid intensifier which can operate reliably and without supervision for long periods of time. Another objective is to provide a fluid intensifier which can operate under a variety of environmental conditions. In accordance with these objectives, the fluid intensifier of this invention is self priming and can operate from an erratic fluid source.

Briefly, the invention comprises an elongated main cylinder assembly, a stationary assembly and a reciprocating assembly disposed within the main cylinder assembly, and a bistable valve mechanism. The stationary assembly includes a fixed piston centrally located within the main cylinder assembly, and a pair of output tubes extending from the ends of the main cylinder assembly to the fixed piston. The reciprocating assembly includes a pair of movable pistons located between the fixed piston and the ends of the main cylinder assembly, and a movable cylinder attaching the two movable pistons together and enclosing the fixed piston of the stationary assembly. The bistable valve mechanism has two stable states and is switched by movement of the reciprocating assembly. In the first stable state the bistable valve mechanism is operative to couple the fluid source to an orifice at a first end of the main cylinder assembly to drive the reciprocating assembly towards the second end, and in the second state the bistable valve mechanism is operative to couple the fluid source to an orifice at a second end of the main cylinder assembly to drive the reciprocating assembly towards the first end.

The bistable valve mechanism includes a tubular collar disposed within the main cylinder assembly between the two movable pistons, a control cylinder attached to the outside of the main cylinder assembly, and a spool disposed within the control cylinder assembly. The collar is a valve which hydraulically controls the position of the spool within the control cylinder, and thus controls the cycling of the intensifier. The position of the collar is determined by the cycling of the reciprocating assembly, and thus is a kind of mechanical "memory" should the cycle be interrupted due to a loss of fluid pressure.

An advantage of this invention is that it can operate from an interruptable pressurized fluid source. Since the bistable valve mechanism "remembers" which portion of the operating cycle the reciprocating assembly is in, operation can resume at that point in the cycle when fluid pressure is reapplied.

Furthermore, even if the cycle is interrupted at the exact moment of collar cross-over, the spool is still operative (although unbiased) and will eventually cause the pistons to move the collar past the cross-over point.

Another advantage of this invention is that it is self-priming since even after it is run dry it will resume operation after fluid pressure is restored.

Yet another advantage of this invention is that the internal parts of the device can be quickly removed, inspected, and replaced. Furthermore, the pumping ratio of the device can be easily changed by substituting parts of the reciprocating and stationary assemblies.

These and other objects and advantages of the present invention will no doubt become apparent upon a reading of the following descriptions and a study of the several figures of the drawing

BRIEF DESCRIPTION OF THE DRAWING

The drawing of FIG. 1 is a cross-sectional view of a fluid intensifier in accordance with the present invention where the reciprocating assembly within the fluid intensifier is positioned near the beginning of a pump cycle.

DETAILED DESCRIPTION OF THE PREFERRED EMBODIMENT(S)

Figure 1:
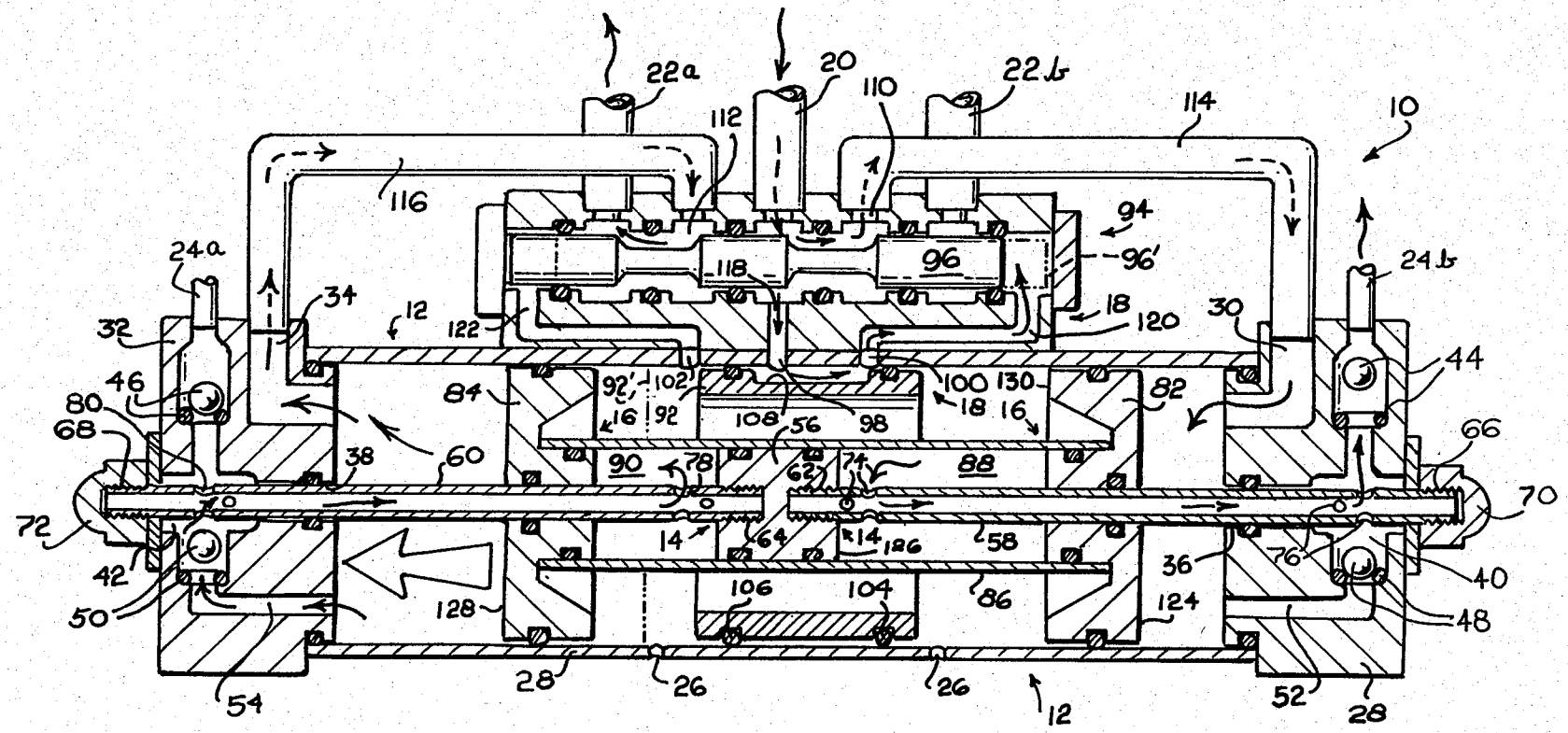

Referring to FIG. 1, a fluid intensifier 10 in accordance with the present invention includes an elongated main cylinder assembly 12, a stationary assembly 14 disposed within main cylinder assembly 12, a reciprocating assembly 16 guided by the stationary assembly 14 within main cylinder assembly 12, and a bistable valve mechanism 18 associated with main cylinder assembly 12. Fluid intensifier 10 has a low pressure inlet 20, a pair of exhaust outlets 22A and 22B, and a pair of high pressure outlets 24A and 24B. Often, exhaust outlets 22A and 22B will be coupled together, and high pressure outlets 24A and 24B will be coupled together. A pair of drain holes 26 are provided in the bottom of the main cylinder assembly 12.

Main cylinder assembly 12 includes a cylindrical portion 27, a first end portion 28 having a first end portion orifice 30, and a second end portion 32 having a second end portion orifice 34. First end portion 28 and second end portion 32 are constructed as headers that are removable from the cylindrical portion 27.

End portions 28 and 32 are provided with axial bores 36 and 38, respectively, and output chambers 40 and 42, respectively. Output chamber 40 is connected to high pressure outlet 24B by a check valve assembly 44, and output chamber 42 is coupled to high pressure outlet 24A by a check valve assembly 46. Outlet chambers 40 and 42 are also provided with refill check valve assemblies 48 and 50, respectively, which allow fluid to flow into output chambers 40 and 42 through refill passages 52 and 54, respectively.

Stationary assembly 14 includes a fixed piston 56, an output tube 58, and an output tube 60. Fixed piston 56 is supported near the center of cylindrical portion 27 by outlet tubes 58 and 60. The output tubes 58 and 60 are provided with threaded ends 62 and 64, respectively, which engage threaded bores in fixed piston 56. The other ends of tubes 58 and 60 extend through bores 36 and 38, respectively, of the end portions of the main cylinder assembly assembly, and are provided with threaded ends 66 and 68 which engage end nuts 70 and 72, respectively. Tube 58 is apertured at 74 and 76 and tube 60 is apertured at 78 and 80.

Reciprocating assembly 16 includes a first movable piston 82, a second movable piston 84, and a movable cylinder 86 coupling piston 82 to piston 84. Reciprocating assembly 16 moves as a unit towards second end portion 32 to make a first stroke of a pump cycle, and moves as a unit towards first end portion 28 to complete a second stroke of the pump cycle.

Movable cylinder 86 encloses fixed piston 56 to create a first pump chamber 88 and a second pump chamber 90. Apertures 74 and 76 of tube 58 allow communication between pump chamber 88 and output chamber 40. Apertures 78 and 80 of output tube 60 allow communication between pump chamber 90 and output chamber 42.

Bistable valve mechanism 18 includes a collar 92, a control cylinder 94, and a spool 96. Cylindrical portion 27 is provided with a valve inlet 98, a first valve outlet 100, and a second valve outlet 102.

Collar 92 is preferably a short, tubular member provided with seals 104 and 106 to make a sliding seal with the inner surface of cylindrical portion 27. Collar 92 is provided with a relief section 108 which is operative to couple valve inlet 98 to either valve outlet 100 or to valve outlet 102.

Control cylinder 94 is coupled to low pressure inlet 20 and exhaust outlets 22A and 22B, and is also provided with control cylinder orifices 110 and 112. Control cylinder orifice 110 is coupled to end portion orifice 30 by a conduit 114, and control cylinder orifice 122 is coupled to end portion orifice 34 by a conduit 116. Spool 96 can move back and forth within control cylinder 94 and is operative to couple low pressure inlet 20 to either control cylinder orifice 110 or control cylinder orifice 112. Spool 96 is also operative to couple orifice 112 to exhaust outlet 22A when the low pressure inlet 20 is coupled to orifice 110, and operative to couple orifice 110 to exhaust outlet 22B when low pressure inlet 20 is coupled to orifice 112.

Valve inlet 98, and valve outlets 101 and 102 are coupled to various chambers within cylinder 94 by passages 118–122, respectively. When valve inlet 98 is coupled to valve outlet 100 by collar 92 the spool 96 is in the position shown in FIG. 1. When inlet 98 is coupled to valve outlet 102 spool 96 moves to the position shown at 96'.

The operation of this invention will be discussed from the starting point shown in FIG. 1. The reciprocating assembly 16 is shown to be closer to first end portion 28 than to second end portion 32, and collar 92 is coupling valve inlet 98 to valve outlet 100. When a low pressure fluid source is applied to inlet 20, it will flow out of orifice 110, through conduit 114, and into orifice 30 of first end portion 28. The low pressure fluid will also flow through inlet 98, outlet 100, and passage 120 to bias spool 96 to the left of control cylinder 94.

The fluid flowing into orifice 30 will act against a face 124 of movable piston 82 to move the entire reciprocating assembly 16 towards second end portion 32. As assembly 16 moves to the left, the area within pump chamber 88 is compressed and any fluid located therein is forced through apertures 74 of tube 58 and out apertures 76 into the output chamber 40. The fluid being pumped through the output tube 58 is at a higher pressure than the fluid flowing into inlet 20 because the area of face 126 of fixed piston 56 is less than the area of face 124 of the movable piston 82. The high pressure fluid within output chamber 40 holds check valve assembly 48 closed and opens check valve assembly 44. Fluid will flow out of outlet 24B at a higher pressure than it is flowing into inlet 20.

As the reciprocating assembly moves to the left, fluid within the cylindrical portion 27 is being forced out orifice 34 by a face 128 of movable piston 84. The fluid flowing from orifice 34 is coupled by conduit 116 to orifice 112 of the control cylinder 94, and is allowed to flow out exhaust outlet 22*a*. The pressure of the fluid flowing from exhaust outlet 22*a* will be less than the pressure of the fluid flowing into inlet 20 since some of the fluid pressure energy had been transferred to the high pressure output fluid. Piston 84 also forces fluid through passage 54 to open check valve 50 to chamber 42. From there, the low pressure fluid will flow through apertures 80, tube 60, and out apertures 78 to pump chamber 90. Thus, as high pressure fluid is being pumped from pump chamber 88, the other pump chamber 90 is being refilled with fluid.

Reciprocating assembly will continue to move to the left as the first stroke of the pump cycle progresses. When a shoulder 130 of the movable piston 82 contacts the end of collar 92 the reciprocating assembly 16 will push the collar to the position shown at 92' to couple valve inlet 98 to valve outlet 102. This, in turn, will cause fluid to flow through passage 122 to bias the spool 96 to the position shown at 96' to couple inlet 20 to orifice 112, and to couple orifice 110 to outlet 22B. This will cause the reciprocating assembly 16 to make a stroke to the right which will pump fluid under high pressure from outlet 24A in a manner identical to that described above.

As is evident from the discussion above, the bistable valve mechanism has two stable states corresponding to the position in the pump cycle of that the reciprocating mechanism is in In the first state, collar 92 is in the position shown in FIG. 1 and the spool is firmly biased as shown. If the fluid pressure at inlet 20 were to drop to zero, the collar and spool would remain in position to "remember" which way the fluids should be directed to resume the pump cycle. When the fluid pressure is reapplied to inlet 20 the reciprocating assembly would continue its cycle from where it left off. The same is true when the collar is in position 92' and spool is in position 96'.

The construction of the present invention is such that the intensifier can be quickly taken apart for repair, inspection or modification. For example, by removing end nuts 70 and 72, the end portions 28 and 32 can be removed. Once the end portions are removed the stationary assembly 14 and the reciprocating assembly assembly 16 can be pulled out of main cylinder 12. Reassembly can be accomplished just as quickly.

Since the stationary assembly 14 and the reciprocating assembly 16 can be easily removed and replaced, it becomes practical to have a fluid intensifier with a quickly changeable pumping ratio. To change the pumping ratio, only members 82, 84, 86, and 56 need be replaced.

While this invention has been described in terms of a single preferred embodiment, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A fluid intensifier powered by a pressurized fluid source and comprising:

(a) an elongated main cylinder assembly having a first end portion provided with a first end portion orifice and a first main cylinder assembly outlet; a second end portion provided with a second end portion orifice and a second main cylinder assembly outlet; and a solitary input port into which fluid from a pressurized fluid source may flow;

(b) a stationary assembly including a fixed piston centrally located within said main cylinder assembly; a first output tube extending between said first end portion and said fixed piston; and a second output tube extending between said second end portion and said fixed piston; wherein both said first output tube and said second output tube are provided with apertures proximate their ends permitting fluid communication through said tubes;

(c) a reciprocating assembly including a first movable piston disposed within said main cylinder assembly between said first end portion and said fixed piston; a second movable piston disposed within said main cylinder assembly between said second end portion and said fixed piston; and a movable cylinder coupling said first movable piston to said second movable piston and enclosing said fixed piston; said reciprocating assembly completing a pump cycle with a first stroke in the direction of said second end portion and a second stroke in the direction of said first end portion such that a portion of said fluid from said pressurized fluid source is pumped at a pressure greater than that of the pressurized fluid source through said first output tube and out said first main cylinder assembly outlet during said first stroke, and a portion of said fluid from said pressurized fluid source is pumped at a pressure greater than that of the pressurized fluid source through said second output tube and out said second main cylinder assembly outlet during said second stroke, the remainder of said fluid from said pressurized fluid source being exhausted from said main cylinder at a pressure less than that of the pressurized fluid source; and (d) bistable valve means coupled to said main cylinder assembly and having a first stable state and a second stable state; said bistable valve means switching from said first stable state to said second stable state at the end of said first stroke, and switching from said second stable state to said first stable state at the end of said second stroke; and bistable valve means including first means moved between said first stable state and said second stable state by the movement of said reciprocating assembly and operative to develop a hydraulic signal of its stable state, and second means responsive to said hydraulic signal and operative to direct said pressurized fluid source to said first end portion orifice when said first means is in said first stable state, and to couple said pressurized fluid source to said second end portion orifice when said first means is in said second stable state.

2. A fluid intensifier powered by a pressurized fluid source and comprising:

(a) an elongated main cylinder assembly having a first end portion provided with a first end portion orifice and a first main cylinder assembly outlet; and a second end portion provided with a second end portion orifice and a second main cylinder assembly outlet;

(b) a stationary assembly including a fixed piston centrally located within said main cylinder assembly; a first output tube extending between said first end portion and said fixed piston; and a second output tube extending between said second end portion and said fixed piston; wherein both said first output tube and said second output tube are provided with apertures proximate their ends permitting fluid communication through said tubes;

(c) a reciprocating assembly including a first movable piston disposed within said main cylinder assembly between said first end portion and said fixed piston; a second movable piston disposed within said main cylinder assembly between said second end portion and said fixed piston; and a movable cylinder coupling said first movable piston to said second movable piston and enclosing said fixed piston; said reciprocating assembly completing a pump cycle with a first stroke in the direction of said second end portion and a second stroke in the direction of said first end portion; whereby fluid is pumped through said first output tube and out said first main cylinder assembly outlet during said first stroke, and pumped through said second output tube and out said second main cylinder assembly outlet during said second stroke; and (d) bistable valve means coupled to said main cylinder assembly and having a first stable state and a second stable state; said bistable valve means switching from said first stable state to said second stable state at the end of said first stroke, and switching from said second stable state to said first stable state at the end of said second stroke; said bistable valve means being operative to couple said pressurized fluid source to said first end portion orifice when in said first stable state, and to couple said pressurized fluid source to said second end portion orifice when in said second stable state; wherein said bistable valve means includes collar means disposed within said main cylinder assembly between said first movable piston and said second movable piston, said collar means being pushed by said reciprocating assembly from a first stable position to a second stable position at the end of said first stroke and from said second stable position to said first stable position at the end of said second stroke.

3. A fluid intensifier as recited in claim 2 wherein said main cylinder assembly is provided with a valve inlet coupled to said pressurized fluid source, a first valve outlet, and a second valve outlet; where said valve inlet is coupled to said first valve outlet when said collar means is in said first stable position, and where said valve inlet is coupled to said second valve outlet when said collar means is in said second stable position.

4. A fluid intensifier as recited in claim 3 wherein said bistable valve means further includes a control cylinder and a spool disposed within said control cylinder for reciprocating motion therein; said first valve outlet and said second valve outlet being coupled to said control cylinder so as to control the position of said spool within said control cylinder; said spool being operative to couple said pressurized fluid source to said first end portion orifice when said collar is in said first stable position, and operative to couple said pressurized fluid source to said second end portion orifice when said said collar is in said second stable position.

5. A fluid intensifier as recited in claim 4 wherein said control cylinder is further provided with exhaust outlet means, and wherein said spool is further operative to couple said first end portion orifice to said exhaust outlet means when said collar is in said second stable position, and operative to couple said second end portion orifice to to said exhaust outlet means when said collar is in said first stable position.

6. A fluid intensifier as recited in claim 5 wherein said first end portion is further provided with a first output chamber and a first output check valve permitting fluid to flow from said first output chamber to said first main cylinder assembly outlet; and wherein said second end portion is further provided with a second output chamber and a second output check valve permitting fluid to flow from said second output chamber to said second main cylinder assembly outlet; where said first output tube opens on said first output chamber and said second output tube opens on said second output chamber.

7. A fluid intensifier as recited in claim 6 wherein said first end portion is further provided with a first refill check valve permitting fluid to flow from said first end portion orifice to said first output chamber; and wherein said second end portion is further provided with a second refill check valve permitting fluid to flow from said second end portion orifice to said second output chamber.

8. A fluid intensifier powered by a pressurized fluid source and comprising:

(a) an elongated main cylinder assembly having a first end portion provided with a first end portion orifice and a first main cylinder assembly outlet; a second end portion provided with a second end portion orifice and a second main cylinder assembly outlet; and a solitary input port into which fluid from a pressurized fluid source may flow;

(b) a stationary assembly including a fixed piston centrally located within said main cylinder assembly; a first output tube extending between said first end portion and said fixed piston; and a second output tube extending between said second end portion and said fixed piston; wherein both said first output tube and said second output tube are provided with apertures proximate their ends permitting fluid communication through said tubes;

(c) a reciprocating assembly including a first movable piston disposed within said main cylinder assembly between said first end portion and said fixed piston; a second movable piston disposed within said main cylinder assembly between said second end portion and said fixed piston; and a movable cylinder coupling said first movable piston to said second movable piston and enclosing said fixed piston; said reciprocating assembly completing a pump cycle with a first stroke in the direction of said second end portion and a second stroke in the direction of said first end portion such that a portion of said fluid from said pressurized fluid source is pumped at a pressure greater than that of the pressurized fluid source through said first output tube and out said first main cylinder assembly outlet during said first stroke, and a portion of said fluid from said pressurized fluid source is pumped at a pressure greater than that of the pressurized fluid source through said second output tube and out said second main cylinder assembly outlet during said second stroke, the remainder of said fluid from said pressurized fluid source being exhausted from said main cylinder at a pressure less than that of the pressurized fluid source; and (d) bistable valve means coupled to said main cylinder assembly and having a first stable state and a second stable state; said bistable valve means switching from said first stable state to said second stable state at the end of said first stroke, and switching from said second stable state to said first stable state at the end of said second stroke; and bistable valve means being operative to couple said pressurized fluid source to said first end portion orifice when in said first stable state, and to couple said pressurized fluid source to said second end portion orifice when in said second stable state; where said bistable valve means includes collar means disposed within said main cylinder assembly between said first movable piston and said second movable piston; said collar means being pushed by said reciprocating assembly from a first stable position to a second stable position at the end of said first stroke and from said second stable position to said first stable position at the end of said second stroke.

9. A fluid intensifier as recited in claim 1 wherein said main cylinder assembly is provided with a valve inlet coupled to said pressurized fluid source, a first valve outlet, and a second valve outlet; where said valve inlet is coupled to said first valve outlet when said collar means is in said first stable position, and where said valve inlet is coupled to said second valve outlet when said collar means is in said second stable position.

10. A fluid intensifier as recited in claim 9 wherein said bistable valve means further includes a control cylinder and a spool disposed within said control cylinder for reciprocating motion therein; said first valve outlet and said second valve outlet being coupled to said control cylinder so as to control the position of said spool within said control cylinder; said spool being operative to couple said pressurized fluid source to said first end portion orifice when said collar is in said first stable position, and operative to couple said pressurized fluid source to said second end portion orifice when said said collar is in said second stable position.

11. A fluid intensifier as recited in claim 10 wherein said control cylinder is further provided with exhaust outlet means, and wherein said spool is further operative to couple said first end portion orifice to said exhaust outlet means when said collar is in said second stable position, and operative to couple said second end portion orifice to to said exhaust outlet means when said collar is in said first stable position.

12. A fluid intensifier as recited in claim 11 wherein said first end portion is further provided with a first output chamber and a first output check valve permitting fluid to flow from said first output chamber to said first main cylinder assembly outlet; and wherein said second end portion is further provided with a second output chamber and a second output check valve permitting fluid flow from said second output chamber to said second main cylinder assembly outlet; where said first output tube opens on said first output chamber and said second output tube opens on said second output chamber.

13. A fluid intensifier as recited in claim 12 wherein said first end portion is further provided with a first refill check value permitting fluid to flow from said first end portion orifice to said first output chamber; and wherein said second end portion is further provided with a second refill check valve permitting fluid to flow from said second end portion orifice to said second output chamber.

* * * * *